United States Patent [19]

Robinson

[11] Patent Number: 4,557,715

[45] Date of Patent: Dec. 10, 1985

[54] TUCK ASSEMBLY FOR A POCKET FILE FOLDER LINE

[75] Inventor: Daniel T. Robinson, Greenfield, Wis.

[73] Assignee: Kempsmith Machine Company, Milwaukee, Wis.

[21] Appl. No.: 556,928

[22] Filed: Dec. 1, 1983

[51] Int. Cl.[4] ..... B31B 33/26; B31B 1/78

[52] U.S. Cl. ..... 493/244; 493/443; 493/918; 493/947

[58] Field of Search ..... 493/244, 947, 310, 311, 493/409, 403, 918, 434, 435, 454, 442, 443, 241, 263, 186, 419, 452, 940

[56] References Cited

U.S. PATENT DOCUMENTS

| | | | |
|---|---|---|---|
| 407,813 | 7/1889 | Burdick | 493/244 |
| 410,843 | 9/1889 | Lorenz | 493/244 |
| 446,839 | 2/1891 | Patterson | 493/241 |
| 502,847 | 8/1893 | Claussen | 493/244 |
| 2,899,874 | 8/1959 | Normandin | 493/263 |
| 4,016,808 | 4/1977 | Young | 493/261 |
| 4,041,849 | 8/1977 | Tsukasaki | 493/442 |
| 4,175,478 | 11/1979 | Tripler | 493/918 |

*Primary Examiner*—Francis S. Husar
*Assistant Examiner*—William E. Terrell
*Attorney, Agent, or Firm*—Ronald E. Barry

[57] ABSTRACT

A tuck assembly for automatically inverting the gussets of a pocket file folder as the file folder is moved through a cutting and folding line, the assembly includes a tuck section having a plurality of a V-type tuck rolls of decreasing depth for opening the folded gusset, a guide section for supporting the edges of the file folder pocket and a compression section for folding the open gusset into the edge of the pocket.

12 Claims, 15 Drawing Figures

TUCK ASSEMBLY FOR A POCKET FILE FOLDER LINE

BACKGROUND

File folders/envelopes and pocket file folders are formed on a common type assembly line. A web of material is fed through the line and the creasing, cutting, stripping, buckling, gluing operations are added to the line as needed. In forming a pocket type file folder, gussets are formed along each side of the pocket by cutting a tab on each edge of the file folder and gluing the tabs together in the final step of the process. The resulting folder has the gussets extending outwardly from each side of the pocket which requires special handling because of the increased width of the folder and special storage because of the additional space requirement. At the present time in order to overcome this problem, the gussets are manually tucked into the sides of the pocket on discharge of the file folder from the line.

SUMMARY OF THE INVENTION

The tuck assembly according to the present invention is added to the end of the file folder line and automatically tucks the gusset into the pocket as the file folder is discharged from the compression section of the line. Since this is accomplished in conjunction with the normal flow of file folders through the file folder line, there is no loss of time in making the gusset type pocket file folder. Since the gussets are tucked into the pocket, the file folders can be handled in the same manner as any other folder coming off of the line. No special handling or storage facilities are required for the file folder.

DRAWING

DESCRIPTION OF THE INVENTION

Figure 2:
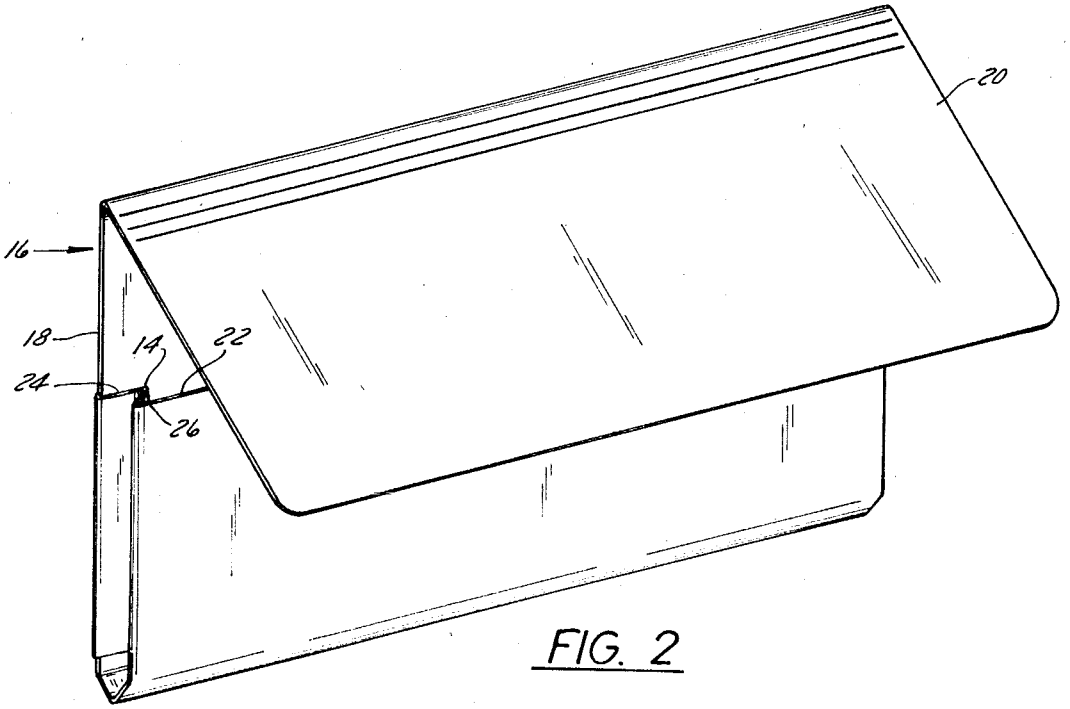
FIG. 2 is a perspective view of a pocket file folder showing the gussets in the tucked position.
Figure 3:
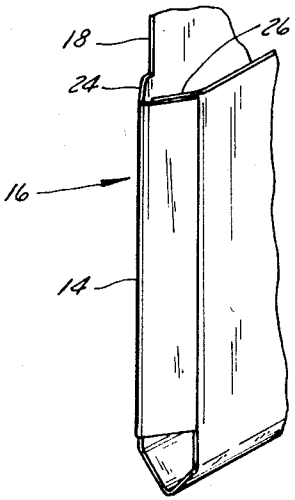
FIG. 3 is a perspective view of a portion of a pocket file folder showing the gusset in the extended or conventional position.

The tuck assembly 10 is provided at the end of a file folder, envelope, and pocket file folder line 12. The tuck assembly 10 is used to tuck the gussets 14 of a pocket file folder 16 into the edges of the pockets. In this regard, a pocket file folder 16 of the type contemplated herein is shown in FIG. 2. The folder includes a back section 18, a front flap 20 and a pocket flap 22. The gussets 14 are formed by tabs 24 and 26 located on the edges of the back section 18 and pocket section 22, respectively. As more clearly described hereinafter, the gussets 14 are formed by gluing a portion of the tab 24 to the tab 26 as seen in FIG. 3. The gusset thus formed normally extends outward from the edge of the file folder. The tuck assembly 10 is used to tuck the gusset 14 into the edge of the pocket formed between the back section 18 and the pocket section 22 as seen in FIG. 2.

FILE FOLDER/ENVELOPE/POCKET FILE FOLDER LINE

Figure 1:
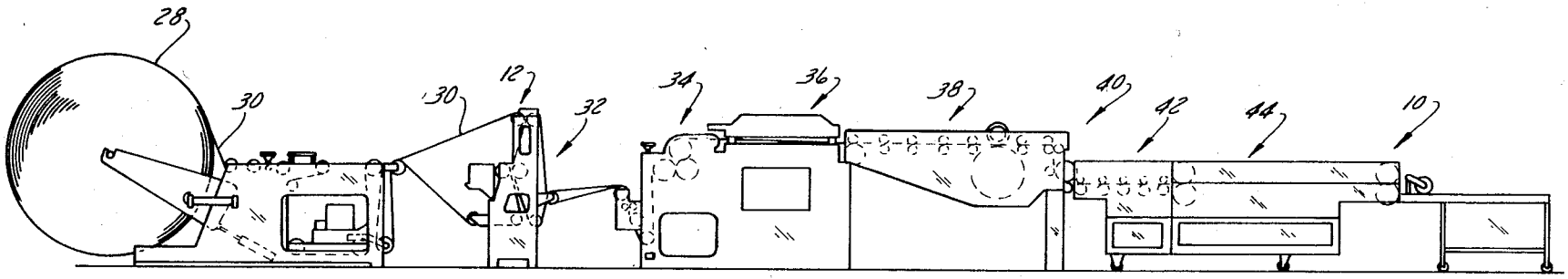
FIG. 1 is a side view in elevation of a file folder, envelope, and pocket file folder line.
Figure 4:
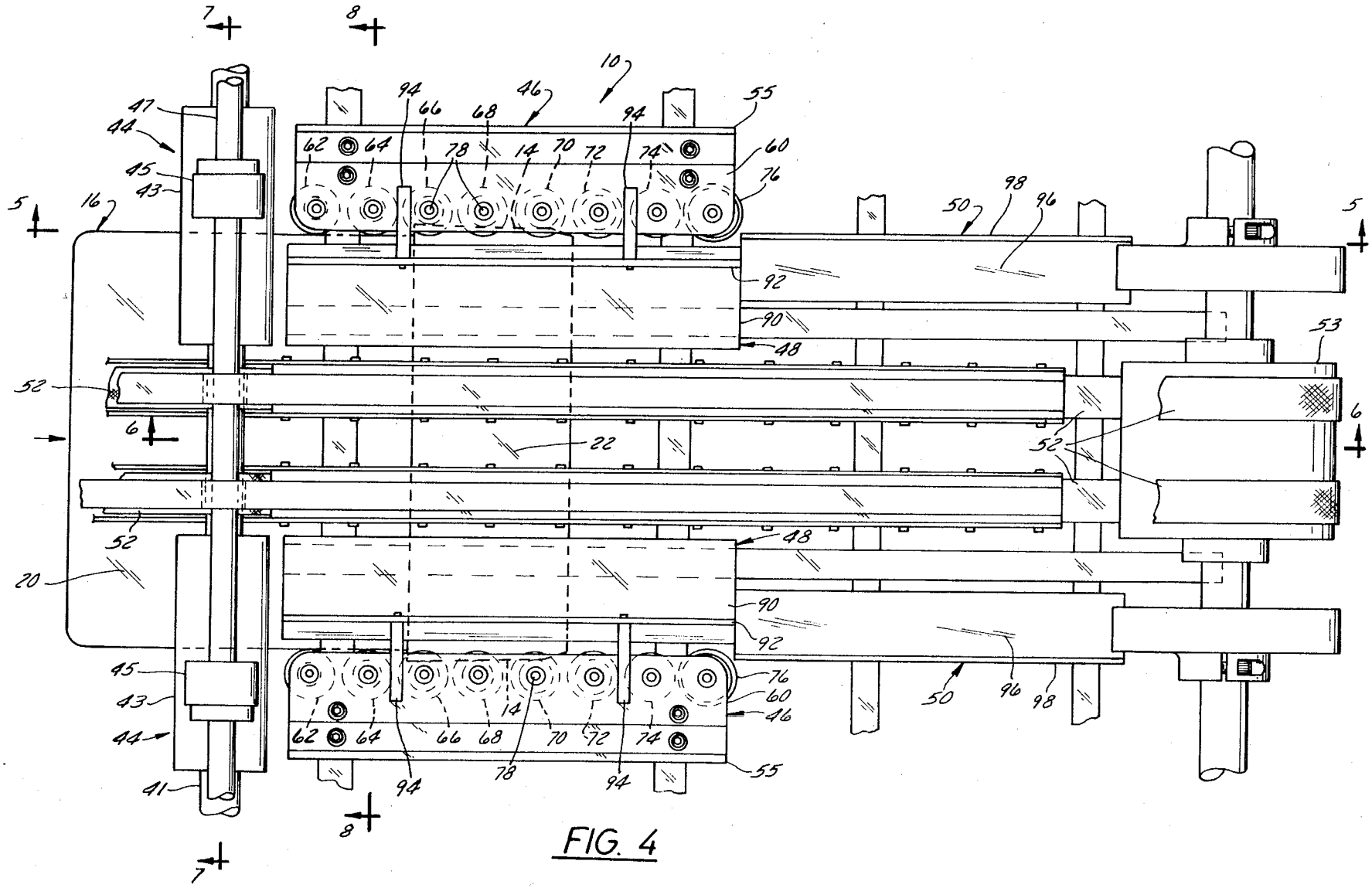
FIG. 4 is a top view of the gusset tuck assembly according to the present invention.
Figure 5:
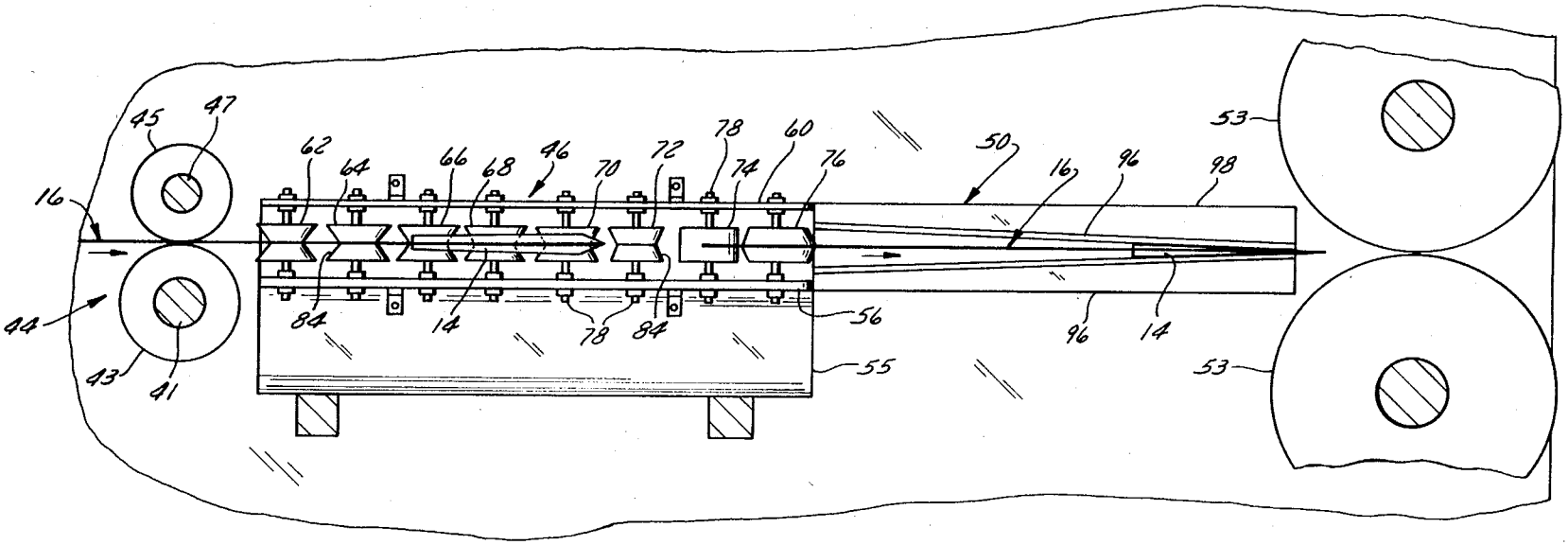
FIG. 5 is a section view taken on line 5—5 of FIG. 4 showing the tuck section of the gusset tuck assembly.
Figure 6:
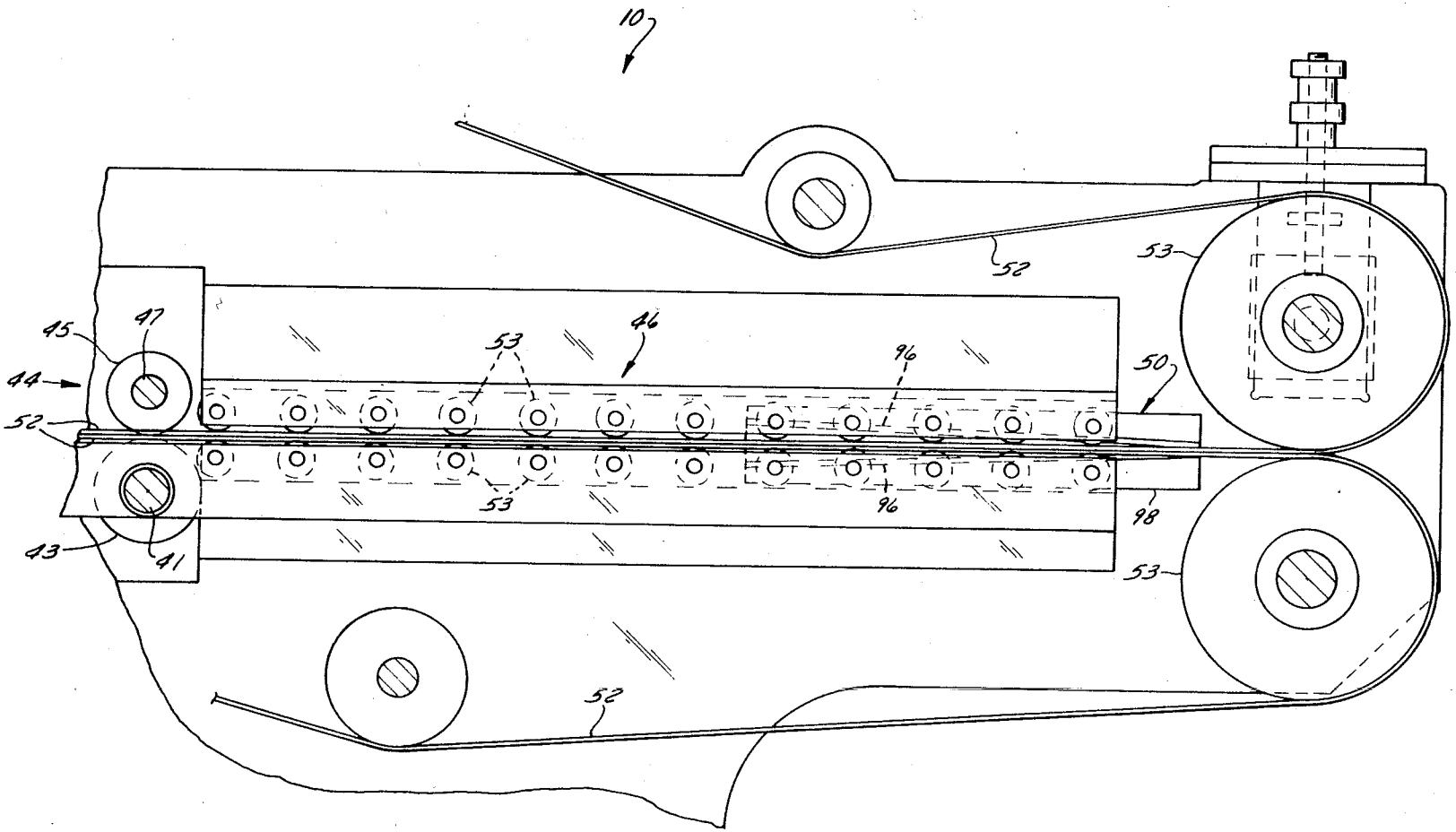
FIG. 6 is a section view taken on line 6—6 of FIG. 4 showing the drive section of a gusset tuck assembly.
Figure 7:
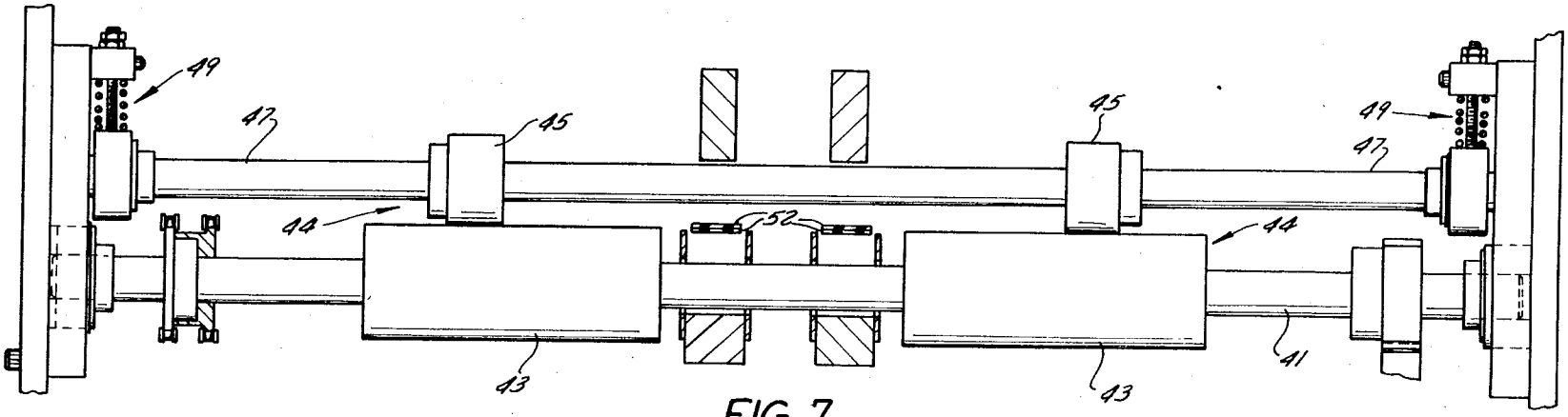
FIG. 7 is a view taken on line 7—7 of FIG. 4 showing the feed roll section to the gusset tuck assembly.
Figure 8:
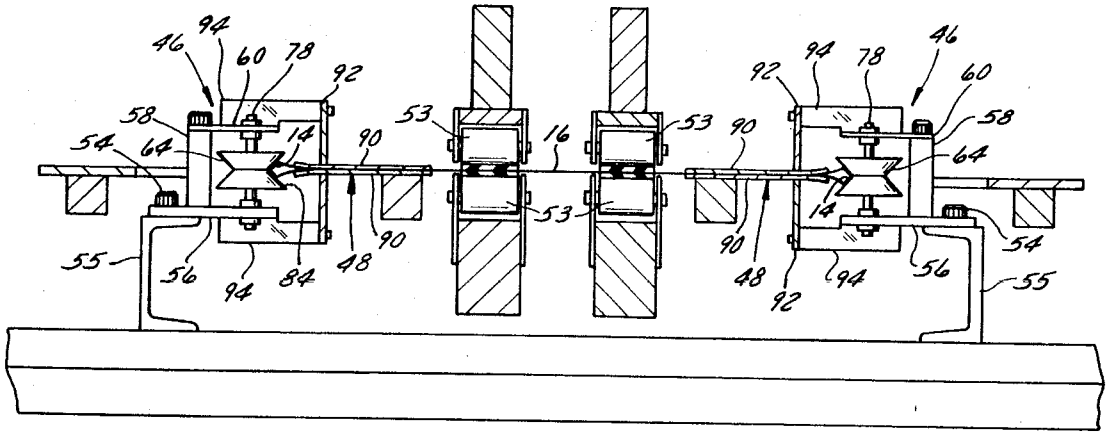
FIG. 8 is a view taken on line 8—8 of FIG. 7 showing a pocket file folder entering the tuck section of the gusset tuck assembly.

Pocket file folders 16 of the type contemplated herein are manufactured on a file folder cutting and folding line as seen in FIG. 1. The line includes a roll of paper 28 having a web 30 which is fed through a feed mechanism 32 to a crease assembly 34, a cutting assembly 36, a stripping assembly 38, a buckling assembly 40, a gluing assembly 42 and a compression assembly 44. The line is designed to manufacture flat file folders, envelopes and pocket file folders. The operation of the line is conventional, involving the steps of creasing the paper in the creasing assembly 34 to provide the fold lines for the file folder blank. The web is cut in the cutting assembly 36 to form the outer shape of the file folder. Excess material is stripped from the cut web at the stripping assembly 38 and the file folder then fed to the buckling or folding assembly 40. The pocket section 22 is folded back onto the back section 18 in the buckling section 40 and then fed to the gluing assembly 42. Glue is applied to the inside surface of the outer portion of the tab 24 and to the outside surface of the tab 26. As the file folder is moved through the compression assembly 44, the outer portion of the tab 24 is folded over the tab 26 and then squeezed in the compression assembly 44 to form the gusset. The file folder 16 as seen in FIG. 4 is then fed into the tuck assembly 10.

In this regard, and referring to FIGS. 4 through 7, the tuck assembly 10 includes a tuck section 46, a guide section 48, and a compression section 50 positioned on each side of the file folder. The file folder 16 is carried from the compression assembly 44 through the tuck assembly 10 by means of a pair of belts 52. The compression assembly 44 includes a lower roller 43 mounted on a shaft 41 and an upper roller 45 mounted on a shaft 47. The shaft 47 can be moved vertically by means of adjustment screws 49 to vary the pressure on the gusset. The belts 52 are supported by rollers 53 located above and below the belts to provide sufficient pressure on the file folder to carry the folder through the tuck assembly.

As the file folder enters the tuck sections 46, the gussets 14 are forced inward to open the gusset and expand the edge of the pocket of the file folder. The file folder is prevented from bending or twisting by means of the guide section 48 which is located in close proximity to the tuck section 46. The gusset is folded inward after it leaves the tuck section 46 by means of the compression section 50 which is located downstream of the guide section 48.

Referring to FIGS. 8, 9, 10 and 11, one of the tuck sections 46 is shown mounted on a portion of the frame 55 by means of a number of bolts 54. The section includes a lower plate 56, a backing plate 58 and a top plate 60. A number of compression rolls 62, 64, 66, 68, 70, 72 and 74 are mounted for rotary motion on pins 78.

Figure 15:
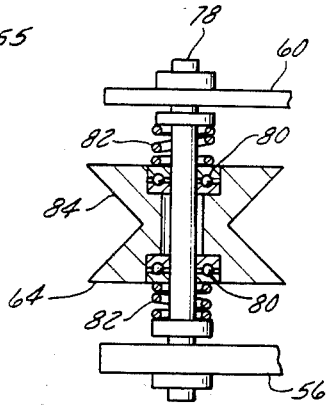
FIG. 15 is an elevation view partly in section showing one of the concave rolls of the tuck section of the gusset tuck assembly.

Referring to FIG. 15, one of the compression rolls 64 is shown mounted on the pin 78 between the plate 56 and plate 60. The roll 64 is supported for rotary motion on the pin 78 by means of roller bearings 80. The roller bearings 80 are supported by means of compression springs 82. With this arrangement the roll 64 is provided with a limited amount of axial motion with respect to the pin 78 to compensate for slight variations in the position of the gussets 14 as they enter the tuck section.

Figure 13:
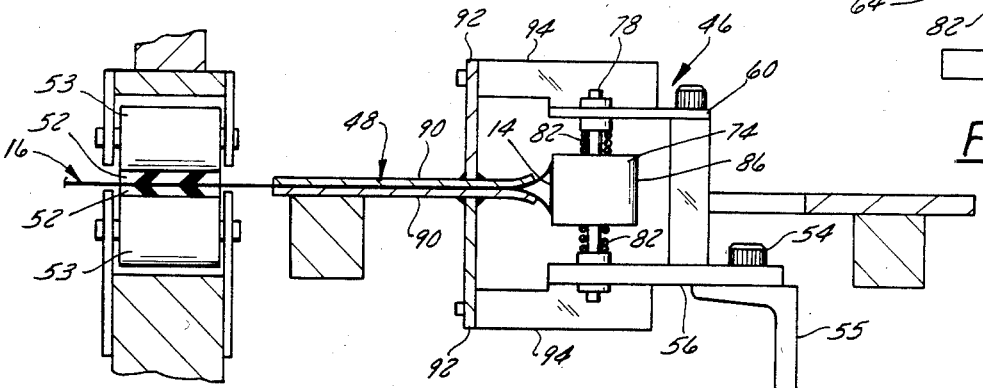
FIG. 13 is a section view showing the position of the gusset on the file folder as the file folder passes through the flat pressure roll in the tuck section of the gusset tuck assembly.

As seen in the drawings, the rolls 62, 64, 66, 68, 70 and 72 are provided with a concave groove 84 which is gradually reduced in depth in the down stream direction. The gussets will be gradually forced inward to open the pocket as the file folder moves through the tuck section. When the file folder reaches the roller 74, which has a flat face as seen in FIG. 13, the gusset will be flattened out. The gusset is initially tucked into the pocket by means of the rolls 76 which have a convex face 88.

Figure 14:
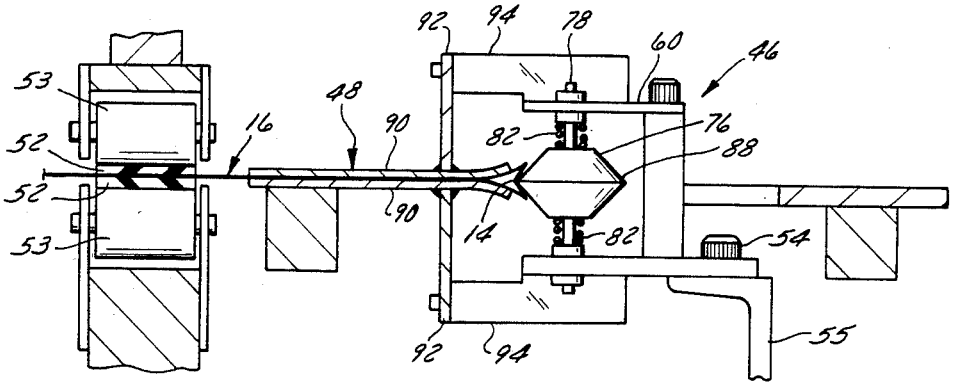
FIG. 14 is a section view showing the gusset on the pocket file folder passing the convex roll in the tuck section.

Means are provided adjacent each tuck section 46 to guide the file folder so that the edge of the folder does not buckle as the gusset is forced into the pocket. Such means is in the form of the guide section which includes a pair of guide plates 90, located on the top and bottom of the file folder as seen in FIGS. 9, 12, 13 and 14. The guide plates 90 are supported by means of vertical plates 92 mounted on brackets 94 which are secured to either the top of the top plate 60 or the bottom of the bottom plate 56 of the tuck section. The guide plates 90 are bent outward at their outer edges to provide a gradually increasing space for the expansion of the edges of the file folder pocket as the gusset is opened to a flat position. After the gusset 14 has been tucked into the edge of the pocket in the file folder by the tuck rolls 76, as shown in FIG. 14, the edges of the file folder are compressed to fold the gusset inward into the pocket by means of the compression section 50.

Figure 9:
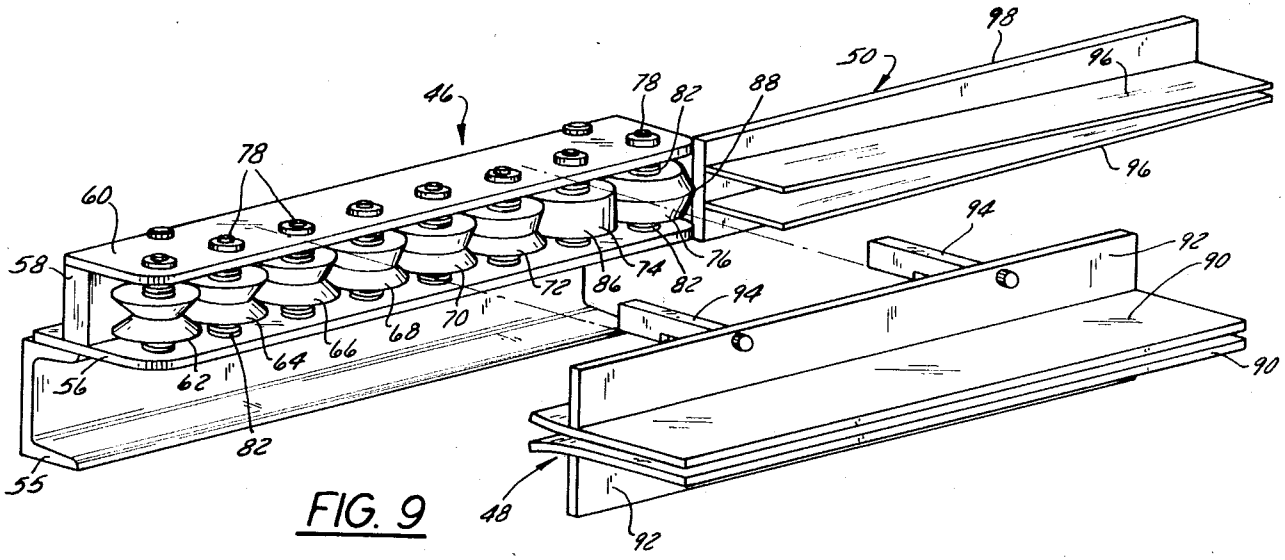
FIG. 9 is an exploded perspective view of one of the tuck sections of the gusset tuck assembly.
Figure 10:
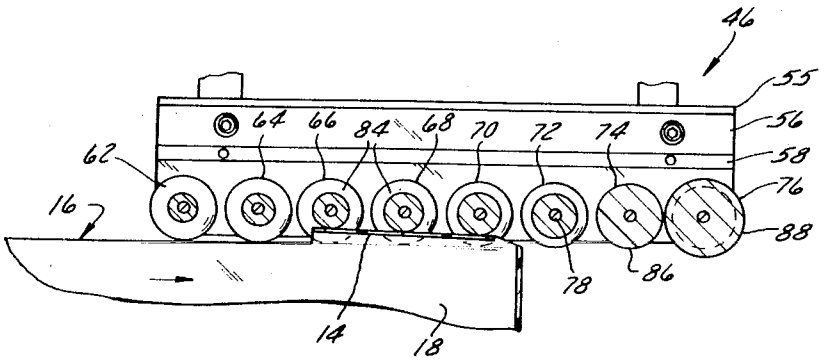
FIG. 10 is a top section view of one of the tuck sections of the gusset tuck assembly showing a file folder entering the tuck section.
Figure 11:
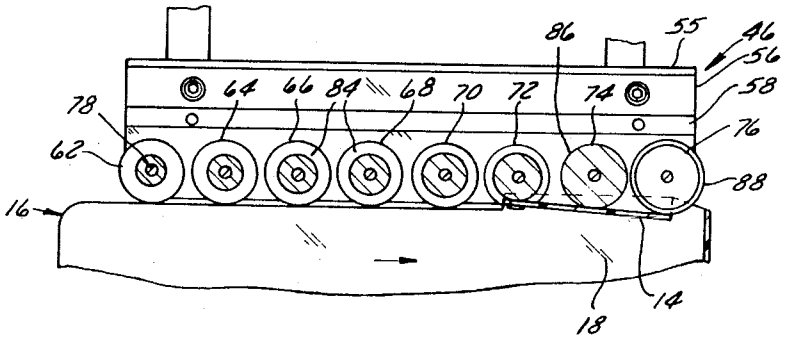
FIG. 11 is a view similar to FIG. 10 showing the file folder moving through the tuck section of the gusset tuck assembly.
Figure 12:
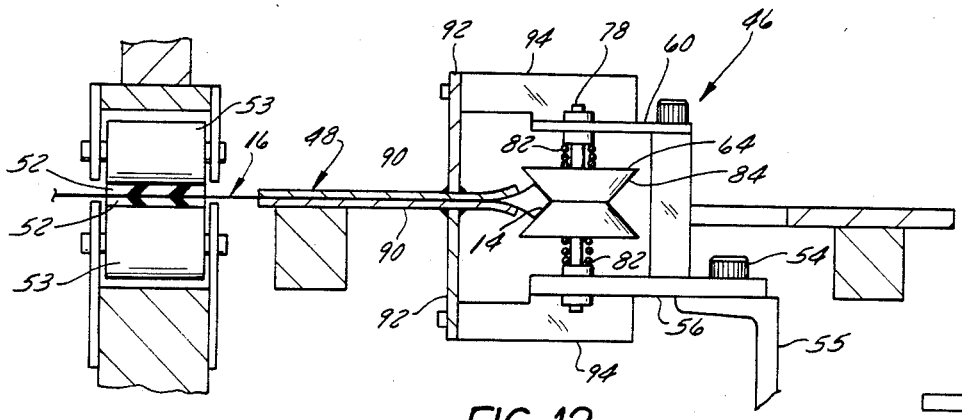
FIG. 12 is a section view showing the extended gusset on a pocket file folder passing one of the concave pressure rolls in the tuck section of the gusset tuck assembly.

In this regard the compression section 50 as seen in FIG. 9 includes a pair of compression plates 96 and a guide plate 98. The compression plates 96 are mounted on the guide plate 98 to form an elongated V-shape which corresponds at the inlet end to the width of the open edge of the pocket of the file folder as the file folder leaves the tuck roll 76. The plates 96 are arranged to taper gradually toward the outlet end. The plates 96 squeeze the edges of the pocket to fold the gusset inward into the pocket. The gusset is prevented from being folded outward as it leaves the tuck roll 76 by means of the guide plate 98 which is aligned with the edge of the file folder as the file folder leaves the tuck section.

The embodiments of the invention in which an exclusive property or privilege is claimed, are defined as follows:

1. The combination with a pocket file folder cutting line, a gusset tuck assembly comprising a tuck section located on each side of the cutting line and including a number of rollers arranged along the path of travel of the edges of the file folder for opening the folded gussets, a roller at the downstream end of each of said tuck sections for tucking the open gusset into the edge of said pocket, and compression means positioned on each side of the cutting line for folding the gusset into the edge of the pocket, said compression means including a pair of plates downstream from each of said tuck sections for folding the gusset into the edge of said pocket and a guide plate positioned at the end of the tuck sections to prevent the gusset from folding outward from the edge of the file folder pocket by the compressive force of the compression plates.

2. The combination according to claim 1 wherein said tuck section includes a number of V-shaped rolls of decreasing depth for gradually opening said gussets as the file folder is moved through the tuck assembly.

3. The combination according to claim 2 wherein said roller at the downstream end of the tuck section includes a convex shaped face for initially tucking the open gusset into the edge of the pocket.

4. The combination according the claim 2 or 3 wherein said compression means includes a pair of pressure plates at the downstreams end of each tuck section mounted in a tapered relation from the inlet end toward the outlet end whereby the edges of the file folder will be compressed to force the gusset into the edge of the pocket as the file folder is moved through the plates.

5. The combination according to claim 4 wherein said compression means includes a guide plate aligned with each edge of the file folder to prevent the gusset from folding outward as the file folder moves through the pressure plates.

6. The combination according to claim 1 or 2 wherein said assembly includes guide means located in close proximity to said tuck section to support the edges of the file folder as the gusset is forced open by said tuck section.

7. A tuck assembly for tucking the gussets of a pocket file folder inside of the edges of the pocket, said assembly including a tuck section located on each side of the path of travel of a pocket file folder, each of said tuck sections including a series of rollers having concave surfaces of decreasing depth for progressively forcing said gusset from the folded condition to an open condition and a roller having a convex surface for initially tucking the gusset into the file folder, guide means positioned next to each tuck section for supporting the edges of the file folder as the gusset is inverted into the pocket of the file folder, said guide means including a pair of plates located adjacent each tuck section, the edges of said plates being curved outwardly in the down stream direction a distance corresponding to the increase in space of the edges of the pocket as the gusset is opened by the tuck section, and compression means located on each side of the path of travel of the file folder for compressing the edges of the pocket of the file folder after the gusset has been tucked therein to force the gusset into the pocket.

8. A tuck assembly for tucking the gussets of a pocket file folder inside of the edges of the pocket, said assembly including a tuck section located on each side of the path of travel of a pocket file folder, each of said tuck sections including a series of rollers having concave surfaces of decreasing depth for progressively forcing said gusset from the folded condition to an open condition and a roller having a convex surface for initially tucking the gusset into the file folder, guide means positioned next to each tuck section for supporting the edges of the file folder as the gusset is inverted into the pocket of the file folder, and compression means located on each side of the path of travel of the file folder for compressing the edges of the pocket of the file folder after the gusset has been tucked therein to force the gusset into the pocket, said compression means including a pair of compression plates located down stream of said tuck section, said plates being spaced apart a distance sufficient to allow the open gusset to enter the compression plates at the inlet end, said plates tapering inwardly toward the outlet end whereby said edges will be compressed to force the gusset into the edge of the pocket as the file folder moves through the compression means.

9. The assembly according to claim 8 wherein said compression means further including a guide plate positioned at the end of each of the tuck sections in a coplaner relation to the open gusset to prevent the gusset from folding outward from the edge of the file folder pocket by the compressive force of the compression plates.

10. In a pocket file folder cutting line a gusset tuck assembly for tucking the gussets formed on the edges of the pockets into the edges of the pockets, said tuck assembly including on each side of said line, concave roller means for opening the gussets, a pair of plates positioned in close proximity to said opening means, each pair of plates having outwardly bent edges positioned to support the edges of the file folder as the gussets open up, convex roller means for initially tucking the gusset into the file folder pocket after the gusset is opened by said concave roller opening means, and compression means located downstream of said tucking means for closing the edges of the file folder to fold the gusset into the edge of the pocket.

11. The gusset tuck assembly according to claim 10 wherein said concave roller means includes a number of rollers mounted on each side of the file folder cutting line in the path of travel of the file folder gussets, each roller having a concave groove of decreasing depth whereby the gusset will be gradually forced to open as the file folder moves through the rollers.

12. In a pocket file folder cutting line a gusset tuck assembly for tucking the gussets formed on the edges of the pockets into the edges of the pockets, said tuck assembly including on each side of said line, concave roller means for opening the gussets, convex roller means for initially tucking the gusset into the file folder pocket after the gusset is opened by said concave roller opening means, and means located downstream of said tucking means for closing the edges of the file folder to fold the gusset into the edge of the pocket, said closing means including a pair of converging plates positioned to engage the edges of the file folder to squeeze the edges together after the gusset has been opened by the opening means.

* * * * *